US005592144A

United States Patent [19]

Greene

[11] Patent Number: 5,592,144

[45] Date of Patent: Jan. 7, 1997

[54] MOOD LAMP

[76] Inventor: James W. Greene, 332 Bleecker St., New York, N.Y. 10014

[21] Appl. No.: 303,669

[22] Filed: Sep. 9, 1994

[51] Int. Cl.[6] ..... G08B 5/00

[52] U.S. Cl. ..... 340/332; 340/286.11; 340/691; 434/237

[58] Field of Search ..... 340/332, 691, 340/286.11; 434/236, 237, 238; 362/252, 806, 810, 811

[56] References Cited

U.S. PATENT DOCUMENTS

| | | | |
|---|---|---|---|
| 4,009,525 | 3/1977 | Hollander | 434/237 |
| 4,041,617 | 8/1977 | Hollander | 434/237 |
| 4,184,344 | 1/1980 | Pepin | 40/502 |
| 4,591,824 | 5/1986 | Lomen | 340/475 |
| 5,072,340 | 12/1991 | Jones | 340/475 |
| 5,089,745 | 2/1992 | Iannini | 340/691 |
| 5,109,214 | 4/1992 | Heidman, Jr. | 340/475 |
| 5,202,660 | 4/1993 | Hartman | 340/332 |
| 5,444,437 | 8/1995 | Layher | 340/286.11 |

*Primary Examiner*—Brent A. Swarthout
*Attorney, Agent, or Firm*—Anthony J. Casella; Gerald E. Hespos

[57] ABSTRACT

A lamp device for communicating moods between users having a base with a plurality of individually illuminatable elements extending from the base and two control units remote from the base for regulating the illumination of the elements. In a preferred embodiment, the illuminatable elements are in the form of five translucent flames of various heights containing two small electric bulbs at their bases for selectively producing colored illumination of each. Appropriate circuitry is disposed in the base member and connected to each of the external control units which may be used to activate the bulbs individually or collectively. The control units may each have five settings designed to supply power in a synchronized manner to the bulbs within the flame elements. Two persons involved in using the lamp for communication each operate a respective control unit which may be concealed, if desired, and by which a level of illumination may be selected to indicate, for instance, the level of interest of the user. When the user couple fails to synchronize their "levels", there is no illumination, but, upon synchronization, a flame of an appropriate color will light up, e.g., if level 1, a blue bulb illuminates the shortest flame. If both select level 2, a yellow bulb may illuminate the next flame in height; level 3, the next highest flame may glow orange; and at level 4, the next highest flame turns pink. At level 5, all of the flames light up in a lush red. Each level may be assigned specific understood psychological definitions that identify the mood or attitude of the users.

3 Claims, 1 Drawing Sheet

MOOD LAMP

BACKGROUND OF THE INVENTION

1. Field of the Invention.

The present invention relates to an illuminating device and more particularly to a lamp with various illumination settings that can be used among other things as a non-verbal indicator of the mood or sexual feelings of two people.

2. Description of the Prior Art.

Lamps are known in various forms and designs for illuminating rooms, articles, areas, and a virtually unlimited number of other such applications. Among the applications is what is called "mood lighting" wherein one or more lamps are used to create an illuminated ambience that is designed to set a special tone that will affect the attitudes or feelings of those present within it. This application, and most others like it, typically involve the pre-arranging of the form of the lamps and the lighting by someone who is in control of the design or operation of the lamps. Consequently, whatever may be communicated by the lamps or lighting is the result of the intent of one person. However, there are many instances in which it would be desirable to permit two people to cooperatively communicate by lighting, particularly by using a single lamp.

For example, after many years of marriage a husband and wife frequently find that their intimacy and lovemaking have diminished considerably. Although the relationship remains essentially healthy, it seems that there never is a "right time" for intimate cooperation. While there is not a lack of desire and interest, the couple just does not seem to catch each other in the same mood. Pressures of work, family, home and civic obligations, and like factors, often make it seem impossible to find the time, energy, or peace of mind to allow for lovemaking. While new physiological knowledge and new emotional attitudes are making it possible for men and women to understand their sexual responses better and enjoy them more fully and freely, still couples have trouble in matching moods and schedules so that they are equally aroused at a suitable moment. This comes from waiting for that mutual "magical sensation" or spontaneous response, the odds against which are so great that sex occurs far less frequently than expected. Further, there are times when one partner is quite aroused and the other is only mildly interested or not at all. Thus, it is important for couples to develop between each other a clear technique for expressing and exchanging their feelings and particularly to achieve clear non-verbal communication since verbal expression is frequently misleading or difficult to manage when dealing with emotions.

Indeed, the response of a partner may communicate an implication of hostility, resignation, or self sacrifice, that can adversely affect the relationship. Couples who learn to convey their individual feelings tactfully from time to time find their sex life improves overall.

3. Objects of the Invention.

It is accordingly an object of the invention to provide a device in the form of a mood lamp for facilitating the elimination of shyness and imagined sexual expectations and, through use of the lamp, to enable the partners to discover the different levels of their own Libido.

It is a further object of the present invention to provide an improved arrangement for enabling people to communicate feelings between each other.

It is another object of the invention to provide an improved lamp that can be controlled by two people engaging in communication between themselves.

It is also an object of the invention to provide a lamp arrangement that will provide improved illumination features and control.

It is a further object of the invention to provide a lamp that is decorative as well as capable of being used for communication.

SUMMARY OF THE INVENTION

The present invention involves a lamp arrangement in the form of a base member having a plurality of individually illuminatable elements extending upwardly therefrom and two sets of remotely disposed controls for regulating the illumination of the elements. In a preferred embodiment, the upstanding elements are of translucent material sculpted in the form of flames of various heights, each containing two small colored electric bulbs at its base for selectively producing the illumination of the flame. Appropriate circuitry is disposed in the base member and connected to the two external control units which may be used to activate the bulbs individually or collectively. The control units each have a series of settings designed to supply power in a synchronized manner to the bulbs within the flame elements. Each person involved in using the lamp for communication has a control unit which may be concealed, if desired, and by which the level of illumination may be used to indicate, for instance, the level of interest of the users. As a user couple synchronize their "levels", through pressing the control settings, a flame of an appropriate color will light up, e.g., a match at level 1 may illuminate a blue bulb in the shortest flame. Similarly, level 2 may illuminate a yellow bulb in the flame next in height; level 3 may light the next highest flame with an orange bulb; and, level 4 lights the next highest flame as pink. If both press level 5, all of the flames light up in a lush red by illuminating red bulbs in each. Each level may be assigned specific understood psychological definitions that identify the mood or attitude of the users. The controls may also be set to initially indicate the mood of one of the parties.

BRIEF DESCRIPTION OF THE DRAWING

The present invention will be described in more detail below with reference to the accompanying drawings in which.

DETAILED DESCRIPTION OF THE PREFERRED EMBODIMENT

Figure 1:
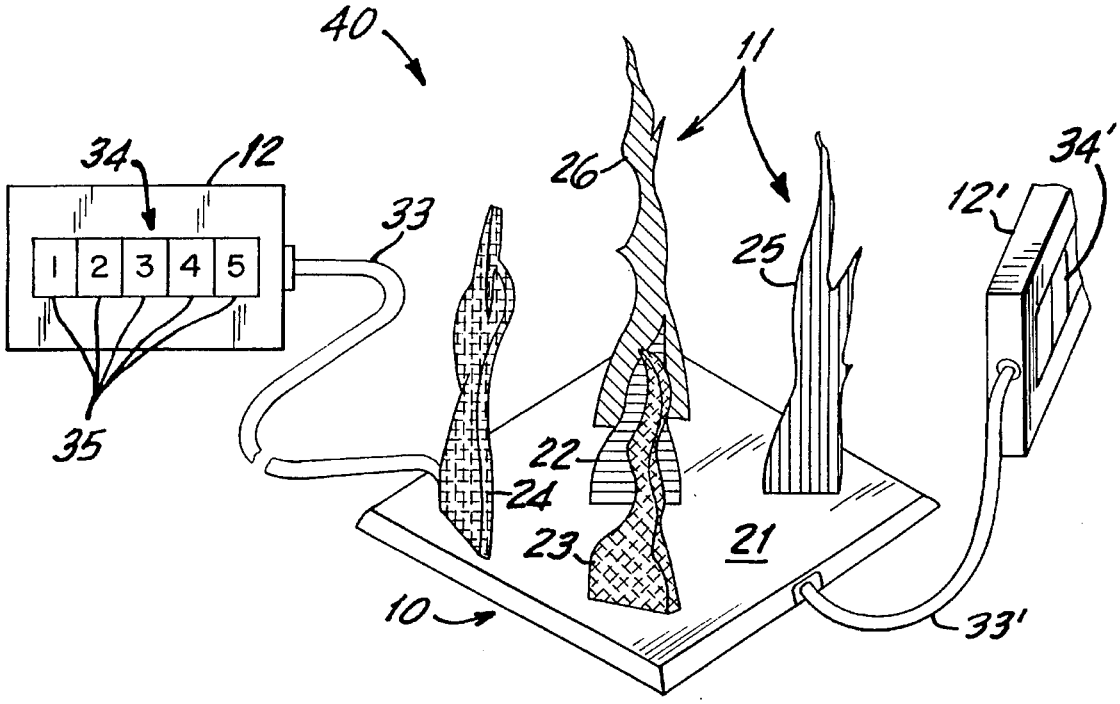
FIG. 1 is a view in perspective of a lamp device in accordance with the invention showing a lamp and its controls.
Figure 2:
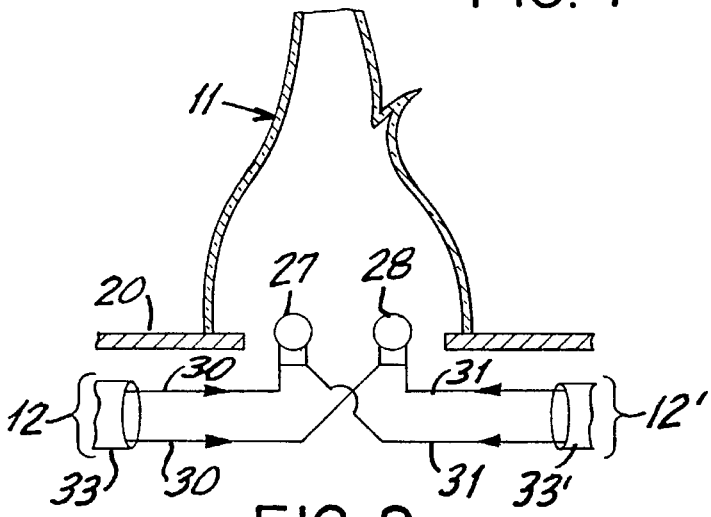
FIG. 2 illustrates the interior of one of the upstanding illuminatable elements of the lamp showing two bulbs and leads of the control circuit.

As seen in FIG. 1 the lamp device of the invention is essentially composed of a base member 10 with a number of illuminatable elements 11 disposed on its upper surface, and two control units 12, 12', which are remotely located from but connected to appropriate circuitry in the base member 10. The decorative design of the base member 10 and elements 11 may be varied in terms of style or appearance. In a preferred embodiment, the base member 10 is a rectangular weighted platform 20, with a hollow interior for housing illumination circuitry, and five upstanding elements 22–26 in the form of flames arranged on the platform surface 21. The platform 20 may be of a choice of materials, such as, acrylic or metal, and the flame elements 22–26 may be of suitable sculpted translucent material, such as, acrylic or crystal, with each flame preferably being of a different height. Disposed in the base of each flame, as shown in FIG. 2, are two small colored electric bulbs, 27 and 28, for illuminating the respective flame element from within. Power to illuminate each of the bulbs is supplied and controlled by two leads 30 and 31 which are respectively connected to the two control units 12 and 12'.

The control units 12, 12' are external to and remote from the base member 10 and connected thereto by multi-lead cables 33, 33', respectively Each unit 12, 12' is provided with a respective key pad 34, 34' or other suitable input means, by which a user can select one of five settings for the five flames 22–26. Each key (1)–(5) is an on/off switch which represents a setting. For example, each of the first four keys or contacts 35 control the supplying of power over an attached lead (30, 31) to one of the bulbs in the base of a respective one of the four flames. Pressing of the first key (1) on pad 34 sends a signal over the attached lead 30 to the bulb 27 in the base of the shortest flame 22. The bulb 27 in the shortest flame 22 may be of the color blue so that, if the bulb is lighted, the flame 22 will glow with a blue hue. The bulbs 27 in the other flames may likewise have characteristic colors. The bulbs 28 in all of the flames are all preferably of the same color and can be simultaneously lighted by the fifth key (5) to produce illumination of all of the flames at the same time. In the preferred cooperative mode, the circuitry is set so that signals must be received coincidently from both control units 12, 12' on leads 30 and 31 to power the attached bulb 27 or 28.

In operation, the lamp device of the invention may be used to communicate the mood or feelings of two users by controlling the specific lighting of the flame elements. Preferably, the lamp can be used by a couple in the cooperative mode to inform each other non-verbally of their mutual moods or feelings, e.g., particularly with regard to lovemaking. More specifically, a husband may have access to control unit 12 and his wife access to unit 12'. The units 12 and 12' are normally remotely located from the lamp and can be concealed so that neither party can tell what setting the other party has selected. This is important since partners are often inhibited and apprehensive of the other's response when sex is desired, fearing rejection or performance out of obligation. At different times of the day each partner can program or set a level of interest using the respective control unit. If one selects a different level from the other, only a single signal will be sent to the respective bulbs in the two flames corresponding to the levels selected and no illumination will result. However, if the selected mood levels match, two signals are sent to the same bulb causing it to light. Consequently, the flame containing that bulb will light up with an appropriate color, e.g., a match at level 1, illuminates the blue bulb 27 in the shortest flame 22. Similarly, a level 2 match may be indicated by the color yellow, so that the signals illuminate a yellow bulb 27 in the flame next in height 23; level 3 lights a orange bulb 27 in the next highest flame 24; and level 4 lights the next to highest flame 25 in pink. If both parties press level 5, signals are sent over leads 30 and 31 to all of the flames 22–26 lighting them up in a lush red by illuminating red bulbs 28 in each. Each level may be assigned a specific agreed upon or understood mood or feeling so that when a flame is illuminated both parties will recognize their mutual level of feelings.

It is contemplated that the invention can be used by two or more people when it is utilized for purposes other than non-verbal communication between couples. Other uses could be of a therapeutic nature or for entertainment or game purposes. For example, the subject invention could be used as a group mood indicator in a therapy setting or as a group scruple indicator when used by a group of friends in a party setting. The appropriate circuitry for achieving the described powering and switching of the lamp components will be within the purview and choice of those skilled in the art.

While the present invention has been described in terms of specific embodiments and combinations, it will be appreciated that the invention is not limited to the particular examples presented herein, and that the scope of the protection is defined in the attached claims.

What is claimed is:

1. A lamp device for non-verbally communicating moods and sexual feelings between two persons, said lamp device comprising:

a base member;

a first elongated illuminatable element projecting from said base member, formed to define a length;

a second elongated illuminatable element projecting from said base member, formed to define a length greater than the length of said first illuminatable element;

at least one elongated intermediate illuminatable element, projecting from said base member, formed to define a length between the length of said first illuminatable element and the length of said second illuminatable element;

a plurality of illuminatable first electric bulbs, each having a different color, one said first electric bulb being disposed within each of said illuminatable elements;

a plurality of illuminatable second electric bulbs, all having a single color, one said second electric bulb being disposed within each of said illuminatable elements; and two separate control means for selectively illuminating the electric bulbs, each said control means being disposed remotely from said base member and connected to the electric bulbs, and each said control means having a plurality of selective settings including a lowest setting, at least one intermediate setting, and a highest setting, each said intermediate setting corresponding to one said intermediate illuminatable element, where the selection of said lowest setting on each said control means illuminates said first electric bulb within said first illuminatable element, the selection of one said intermediate setting on each said control means illuminates said first electric bulb within said corresponding intermediate illuminatable element, and the selection of said highest setting on each said control means illuminates said second electric bulbs within all said illuminatable elements, whereby the illumination of each said illuminatable element non-verbally communicates a mood and sexual feeling.

2. A lamp device as in claim 1, wherein said illuminatable elements comprise members in the form of flames.

3. A lamp device as in claim 1, wherein said illuminatable elements comprise members of a material selected from the group consisting of acrylic and crystal.

* * * * *